US006786236B2

(12) United States Patent
Jansen

(10) Patent No.: US 6,786,236 B2
(45) Date of Patent: Sep. 7, 2004

(54) ELECTROHYDRAULIC SERVO VALVE

(75) Inventor: Harvey B. Jansen, Mesa, AZ (US)

(73) Assignee: Jansen's Aircraft Systems Controls, Inc., Tempe, AZ (US)

( * ) Notice: Subject to any disclaimer, the term of this patent is extended or adjusted under 35 U.S.C. 154(b) by 0 days.

(21) Appl. No.: 10/396,757

(22) Filed: Mar. 21, 2003

(65) Prior Publication Data

US 2003/0178073 A1 Sep. 25, 2003

Related U.S. Application Data

(60) Provisional application No. 60/366,761, filed on Mar. 21, 2002.

(51) Int. Cl.[7] ..... F15B 13/043

(52) U.S. Cl. ..... 137/625.64; 137/625.61

(58) Field of Search ..... 137/625.61, 625.62, 137/625.64

(56) References Cited

U.S. PATENT DOCUMENTS 3,065,145 A * 11/1962 Molander, Jr. et al. . 137/625.64
4,046,061 A * 9/1977 Stokes ..... 137/625.65
4,193,425 A * 3/1980 de la Bouillerie ..... 137/625.64
4,456,031 A 6/1984 Taplin
4,535,815 A 8/1985 Ohumi et al.
5,184,645 A * 2/1993 Boerschig ..... 137/625.65
5,249,603 A 10/1993 Byers, Jr.
5,295,510 A 3/1994 Bolling et al.
5,499,650 A * 3/1996 McArthur et al. ..... 137/625.65

* cited by examiner

*Primary Examiner*—Gerald A. Michalsky
(74) *Attorney, Agent, or Firm*—Quarles & Brady LLP

(57) ABSTRACT

A two, three or four-way valve includes two stages each with working valve components linked by a feedback spring so that a first stage servo unit is auto-nulling and the stroke of the valve member in a second stage valve unit is proportional to the input current to the first stage. An inherently balanced clevis member in the first stage controls flow of pressurized control media, which in combination with direct pressure flow, controls the position of a spool member in the second stage. The spool in turn controls pressure flow to a either one or two metering or input/output flow ports. Transient movement of the clevis due to change in input current to a magnetic servo drive assembly is opposed by bending of the feedback spring arising from the associated movement of the spool, which returns the clevis to its centered null position and stops the spool.

22 Claims, 7 Drawing Sheets

ELECTROHYDRAULIC SERVO VALVE

CROSS-REFERENCE TO RELATED APPLICATION

This application claims benefit to U.S. provisional application Ser. No. 60/366,761 filed Mar. 21, 2002.

STATEMENT OF FEDERALLY SPONSORED RESEARCH OR DEVELOPMENT

Not applicable.

BACKGROUND OF THE INVENTION

1. Technical Field

The present invention relates to valves, and in particular, to multistage electrohydraulic servo valves.

2. Description of the Related Art

Electrohydraulic servo valves are well-known, particularly for use in pilot stages of directional control valves. One such application is for an actuator operating the compressor bleed valve of an aircraft turbofan engine. Electrohydraulic servo valves can have a first stage with an electrical or electromagnetic force motor controlling flow of a hydraulic fluid driving a valve member, such as a spool valve, of a second stage, which in turn can control flow of hydraulic fluid to an actuator driving the load. The force motor can operate to position a movable member, such as a flapper, in response to an input drive signal to drive the second stage valve member. Electrical or mechanical feedback can be provided to return the force motor to the original or null position after the valve member has been moved to its desired position, thereby stopping its movement.

U.S. Pat. No. 4,456,031 discloses one example of an electrohydraulic servo valve. In this case, the valve first stage has a torque motor driving an armature to pivot a flapper member toward and away from two nozzles through which hydraulic fluid can be directed at either of opposing ends of a spool so as to move the spool and thereby control flow to an actuator. Redundant mechanical spring and electrical transducer feedback systems are employed to prevent shut-down of the valve in the event of failure of malfunction of one of the feedback systems. See also U.S. Pat. No. 5,249,603. However, these and other existing systems are disadvantageous in that they do not exhibit both high response and low null leakage, competing attributes that are highly advantageous in hydraulic systems.

Accordingly, an improved multi-stage valve is desired.

SUMMARY OF THE INVENTION

The present invention provide a two stage electrohydraulic servo valve in which the first stage has an inherently balanced variable flow valve member that is auto-nulled by a feedback force from associated movement of the valve member in the second stage. The stroke of the hydraulically driven second stage valve member is proportional to a drive signal input to the first stage.

Specifically, the invention provides an electrohydraulic servo valve having first and second stage units. The first stage servo valve unit has a drive assembly adapted to move a forked clevis member from a null position to alternatively open and close first and second nozzle orifices. When the first nozzle orifice is open flow is permitted between a pressure port and a control port and when the second nozzle orifice is open flow is permitted between the control port and a return port. The second stage valve unit has a sliding valve member as well as an inlet port in communication with the first stage control port, a flow port and a pressure port. Flow from the second stage pressure port to the flow port is controlled by the sliding valve member. The clevis member and the sliding valve member are linked by a feedback spring such that movement of the sliding valve member imparts a feedback force to the feedback spring to return the clevis member to the null position.

In one preferred form, the sliding valve member is a spool cooperating with a half-area piston held stationary by fluid pressure and disposed within a fixed guide sleeve. The spool member moves under the force of flow from the first stage control pressure to close off flow from the second stage pressure or return ports.

In other forms, the valve can have a two-way second stage in which the flow is controlled from the second stage pressure port (with no return port) to a single metering flow port. Or, the valve can have a three-way second stage having a pressure port, a return port and a single input/output flow port. Or, the valve can have a four-way second stage in having pressure, return and two input/output flow ports, in which case flow is discharged from one flow port and taken in through the other flow port.

In another preferred form, wherein the drive assembly is a permanent magnet motor having a wire coil and a movable actuator member connected to the clevis member and disposed along a main axis. The first stage valve unit further includes a flexure pivot allowing the clevis member to pivot with respect to the main axis to control flow through the nozzle orifices. The flexure pivot has a movable part and a non-moving part in a plane spaced from the movable part and joined thereto by a flexible spoke.

In still other preferred forms, the feedback spring has a ball end that is pivotally engaged with the socket or groove in the spool to alleviate binding. The first stage valve unit can include a separate valve body defining the nozzle orifices, which are preferably two pairs of slots through opposite flat sides of the nozzle body. The nozzle body can be partitioned and have a bore through the partition through which the feedback spring extends. In this case, one nozzle orifice is on each side of the partition. Further, the forked end of the clevis member has two prongs, one disposed on opposite sides of the nozzle body. Preferably, each prong has tapered lateral leading edges.

The present invention thus provides an improved electrohydraulic servo valve that is both highly responsive and exhibits low null leakage. These and other benefits are derived in large part to the use of the clevis valve member in the first stage. The clevis arrangement is inherently pressure balanced such that it is highly insensitive to the affects of pressure loading and transient flow forces as well as to pump pressure ripple or noise common in hydraulic or fuel systems, which works to maximize the net drive force during operation. The valve is also highly efficient, empirically exhibiting very high first stage pressure recovery (approximately 97%) and very low hysteresis. The valve is also highly reliable and suitable for use in highly particle contaminated environments, such as jet fuel applications because of a high first stage pressure gain working to clear the spool in the event of sticking. In addition, the valve arrangement is closed centered in that the clevis prongs close the nozzle orifices at the null position such that the valve provides very low null leakage with variable transient flow.

These and still other advantages of the invention will be apparent from the detailed description and drawings. What follows is a preferred embodiment of the present invention. To assess the full scope of the invention the claims should be looked to as the preferred embodiment is not intended as the only embodiment within the scope of the invention.

DETAILED DESCRIPTION OF THE PREFERRED EMBODIMENT

Figure 1:
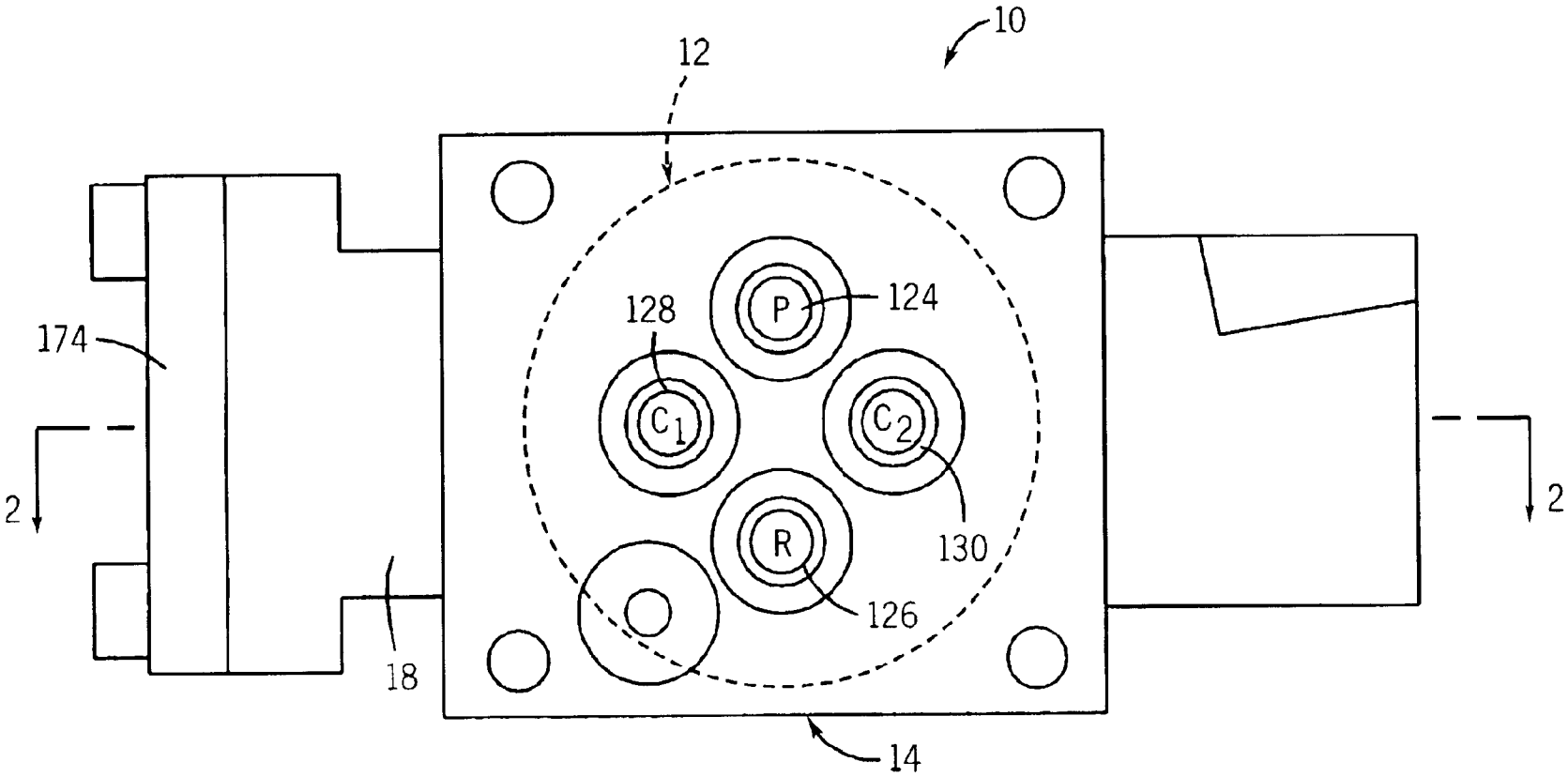
FIG. 1 is bottom plan view of the electrohydraulic valve according to the present invention.
Figure 2:
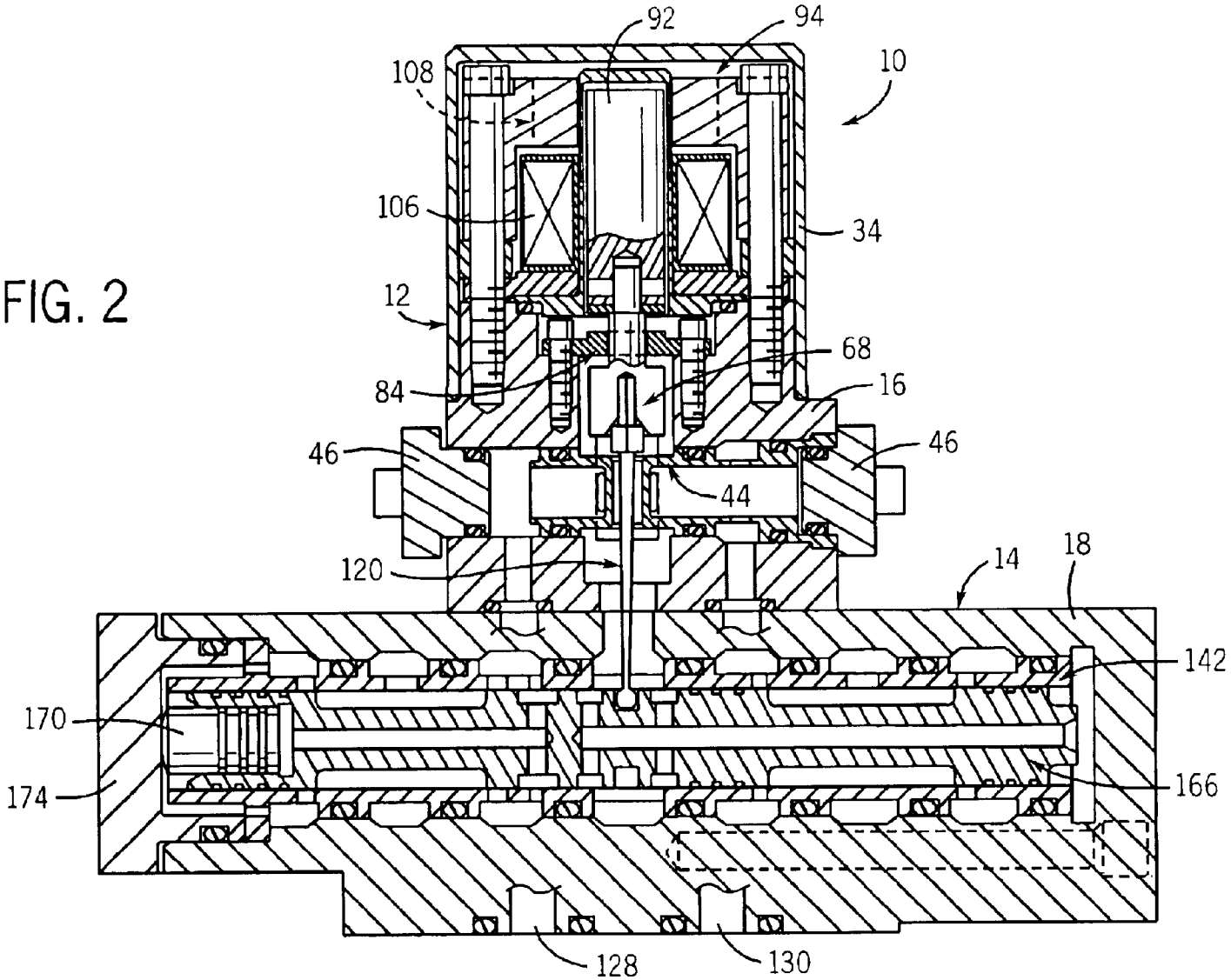
FIG. 2 is a cross-sectional view thereof taken along line 2—2 of FIG. 1 showing the valve in its null position.
Figure 3:
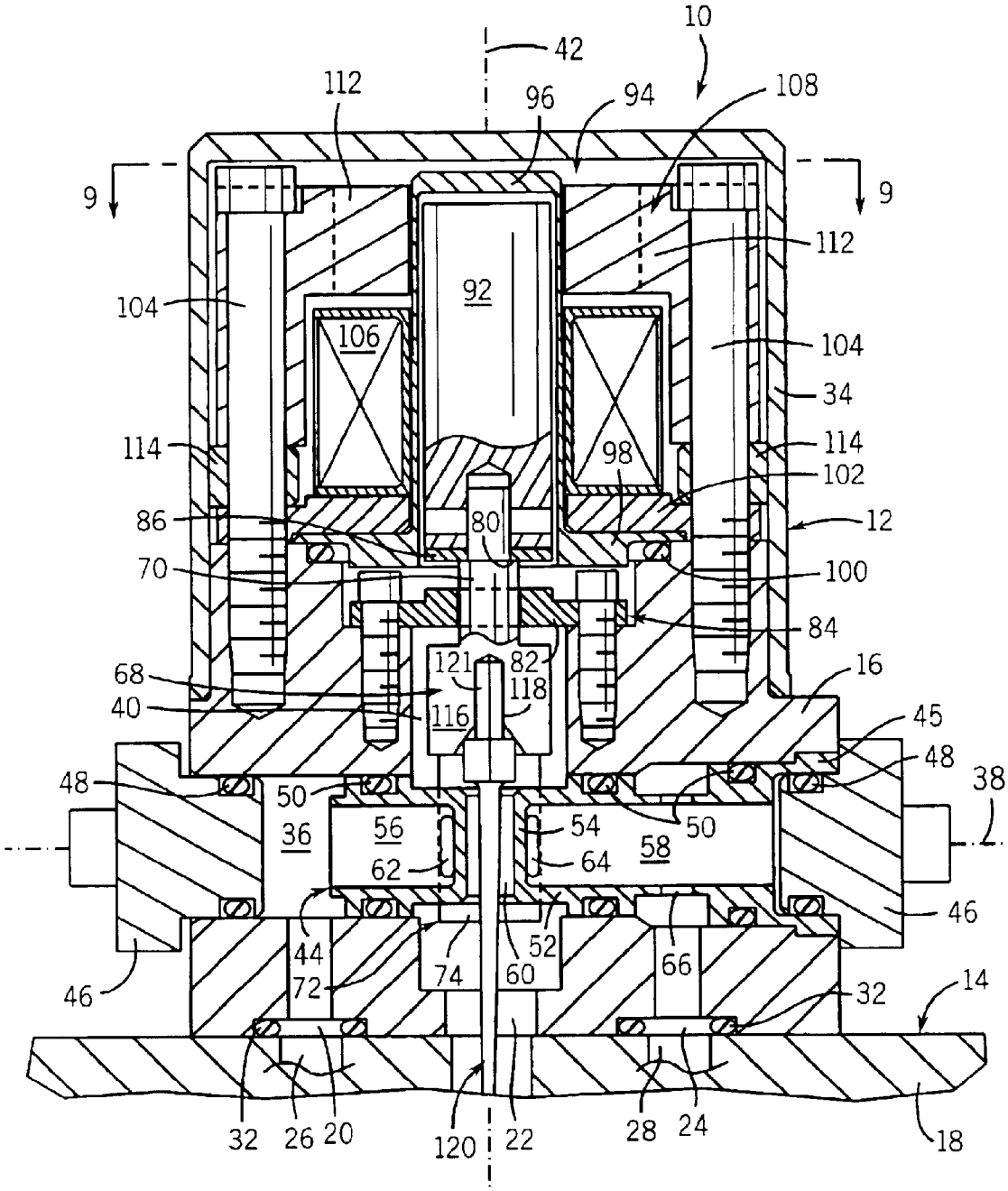
FIG. 3 is an enlarged partial sectional view as in FIG. 2 showing a servo first stage of the valve.

The present invention provides a two stage electrohydraulic servo valve 10, as shown in FIGS. 1 and 2. The valve 10 includes a first stage servo unit 12 and a second stage valve unit 14. With reference to FIGS. 2 and 3, the first stage servo unit 12 has a housing 16 which bolts onto a housing 18 of the second stage valve unit 14. The first stage housing 16 has pressure 20, control 22 and return 24 ports. The pressure 20 and return 24 ports in communication with associated internal routing passageways 26 and 28 in the second stage housing 18, which acts as a manifold block to which connect fuel lines (not shown) leading to and from a fuel supply (not shown). O-rings 32 seal the pressure 20 and return 24 ports.

Figure 5:
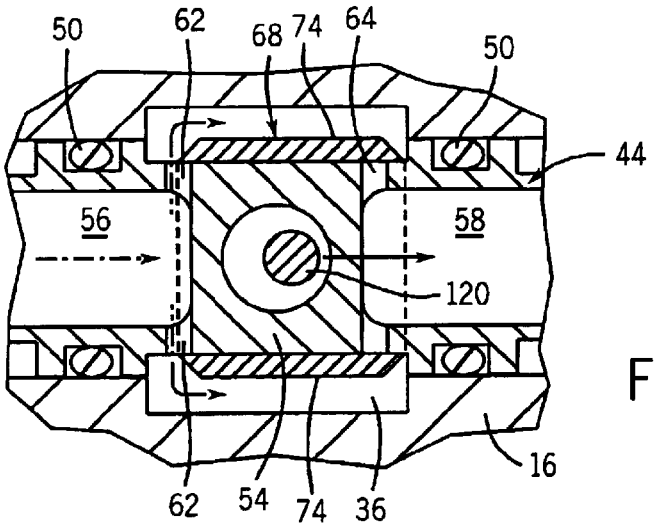
FIG. 5 is a partial sectional view taken along line 5—5 of FIG. 4 showing a clevis member opening a set of nozzle orifices allowing communication between a first stage pressure and control port.
Figure 7:
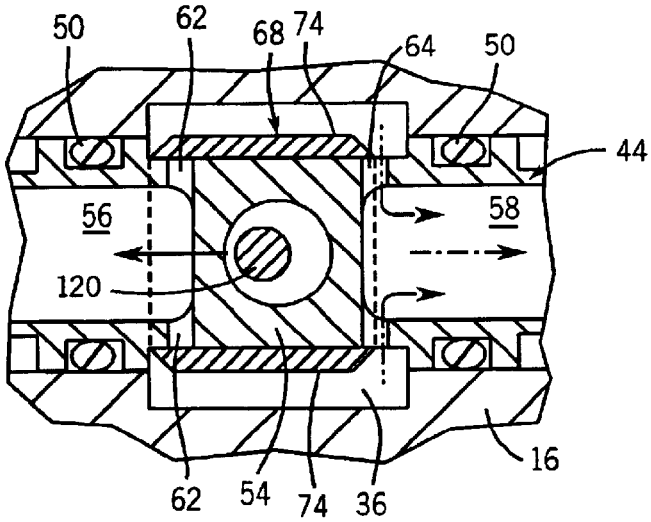
FIG. 7 is a sectional view similar to FIG. 5 albeit taken along line 7—7 of FIG. 6 showing the clevis member opening another set of nozzle orifices allowing communication between the first stage control port and a first stage return port.

Referring to FIG. 3, the first stage housing 16 is enclosed by a cylindrical cover 34 and defines a nozzle chamber 36 concentric with a nozzle axis 38 and a main chamber 40 concentric with a main axis 42 such that the two chambers intersect each other at a right angle. A nozzle body 44 is slid into the nozzle chamber 36 from one end until stopped by abutment of a flared end 45 with the first stage housing 16. The open ends of the nozzle chamber 36 are sealed by plugs 46 (with o-rings 48) bolted to the first stage housing 16. One plug 46 also retains the nozzle body 44 in place. The nozzle body 44 is sealed circumferentially by three spaced apart o-rings 50, one located on one side and two on the other side of an intermediate section 52. This section 52 has a square outer cross-section and defines a partition wall 54 separating the nozzle body 44 into two passageways 56 and 58. A bore 60 concentric with the main axis 42 passes through the wall 54. Four spaced apart slots parallel to the main axis 42 are formed in two opposite sides of the intermediate section 52 of the nozzle body 44 forming two pair of nozzle orifices 62 and 64 on respective left and right sides of the partition wall 54 (see FIGS. 3, 5 and 7). The nozzle orifices 62 open to passageway 56 and nozzle orifices 64 open to passageway 58. Thus, hydraulic fluid, jet fuel in one preferred case, can flow from the pressure port 20 into the nozzle chamber 36 and passageway 56 of the nozzle body 44, and when the nozzle orifices 62 are open (as shown in FIG. 5), out through the control port 22 to the second stage. Alternatively, when nozzle orifices 64 are open (as shown in FIG. 7), fluid can flow from the control port 22 into the nozzle body passageway 58 and out through the return port 24 through four openings 66.

The nozzle orifices 62 and 64 are controlled by a clevis member 68 (shown best in FIGS. 3 and 11) disposed along the main axis 42. The clevis member 68 has a cylindrical stepped diameter stem 70 disposed in the main chamber 40 and an opposite forked end 72 within the nozzle chamber 36 straddling the square intermediate section 52 of the nozzle body 44. The forked end 72 has two spaced apart prongs 74 with tapered leading edges 76 (along their lateral sides) to lower shear forces during operation. The prongs 74 are sized so that the leading edges 76 cover all four of the nozzle orifices 62 and 64 when in a null position in which the clevis member 68 is symmetric about the main axis 42. The symmetric configuration of the clevis member 68 makes it inherently balanced since the same pressure forces will act on each one of the prongs 74.

The clevis member 68 is supported at its stem 70, which fits through a central opening 78 (sized smaller than shoulder 80) of a fixed part 82 of a flexure pivot 84 bolted to the first stage housing 16 concentric with the main axis 42. The flexure pivot 84 has a movable part 86 connected to the fixed part 82 by two spokes 88. The spokes 88 are strong but slightly deflectable to allow relative movement of part 86 with respect to part 82. The movable part 86 has a central opening 90 fit over the smaller diameter section of the clevis stem 70. The movable part 86 and the stem 70 are brazed together with an armature 92 of a magnetic drive assembly 94. The armature 92 is supported by the flexure pivot 84 in a magnetically inert guide sleeve 96 having a flanged end 98 which seals off the main chamber 40, via o-ring 100, by seating against the first stage housing 16. The flanged end 98 of the guide sleeve 96 is held in place by an end plate 102 mounted to the first stage housing 16 by bolts 104 also mounting the drive assembly 94.

Figure 9:
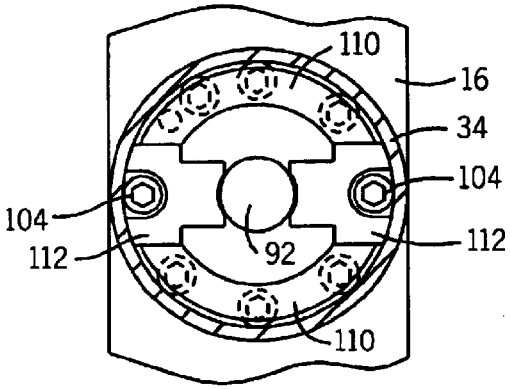
FIG. 9 is a partial sectional view taken along line 9—9 of FIG. 3 showing a permanent magnet arrangement of the first stage.

In addition to the armature 92, the drive assembly 94 includes a wire coil 106 disposed about the guide sleeve 96 between the end plate 102 and a permanent magnet assembly 108. As shown in FIG. 9, the permanent magnet assembly 108 includes two arch shaped permanent magnets 110 as well as two identical ferromagnetic pole pieces 112 arranged in a circle about the main axis 42. The pole pieces 112 extend in a direction parallel to the main axis 42 to fit around an outer diameter of the coil 106. Non-magnetic spacers 114 take up the gap between the ends of the pole pieces 112 and the end plate 102.

The drive assembly 94 thus provides a permanent magnet motor for driving the clevis member 68. Specifically, the pole pieces 112 become magnetized by the permanent magnets 110 and establish north and south poles providing a uni-directional magnetic flux force acting on the armature 92 in the direction from the north pole to the south pole. When current is applied to the coil 106 it acts as an electromagnet providing magnetic flux lines acting on the armature 92 that vary depending on the input current to the coil 106, tending to add or subtract from the force of the permanent magnet flux. The guide sleeve 96 and spacers 114 do not effect the flux path because they are made of magnetically inert materials. The negative spring rate acting on the armature 92 from the magnetic flux lines is coupled with the positive spring rate of the flexure pivot 84 such that the combined force effect on the armature 92 is proportional to the input current to the coil 106. Thus, the net effect on the armature 92 is a force proportional to input current tending to move the armature 92 toward one of opposite sides of the main axis 42 where either of the pole pieces 112 reside.

Because the clevis member 68 (and thereby the armature 92) are supported by the flexure pivot 84, driving the armature 92 side to side will cause the armature 92/clevis member 68/movable part 86 assembly to pivot generally about the center of the fixed part 82 of the flexure pivot 84. Movement of the armature 92 toward the one side of the main axis 42 (e.g., to the right in FIG. 3) moves the forked end 72 of the clevis member 68 in the opposite direction (left in FIG. 3). Note that in the preferred embodiment described herein, the amplitude of travel of the forked end 72 of the clevis member 68 is approximately 0.01 to 0.001 inches in either direction from its resting or null position in which both sets of nozzle orifices 62 and 64 are closed (as shown in FIGS. 2 and 3).

The clevis arrangement thus provides variable fluid flow during transient operation thereby increasing its responsiveness. This arrangement also makes the valve better suited for use in particle contaminated environments since there is no fixed area open orifices as is conventional (which are necessarily very small in diameter due to the low amount of torque provided by the drive assembly) that are susceptible to clogging. Moreover, this arrangement provides high pressure gain at the first stage which assists the valve in the second stage to clear in the event of binding or sticking, thus making it self-clearing.

Figure 4:
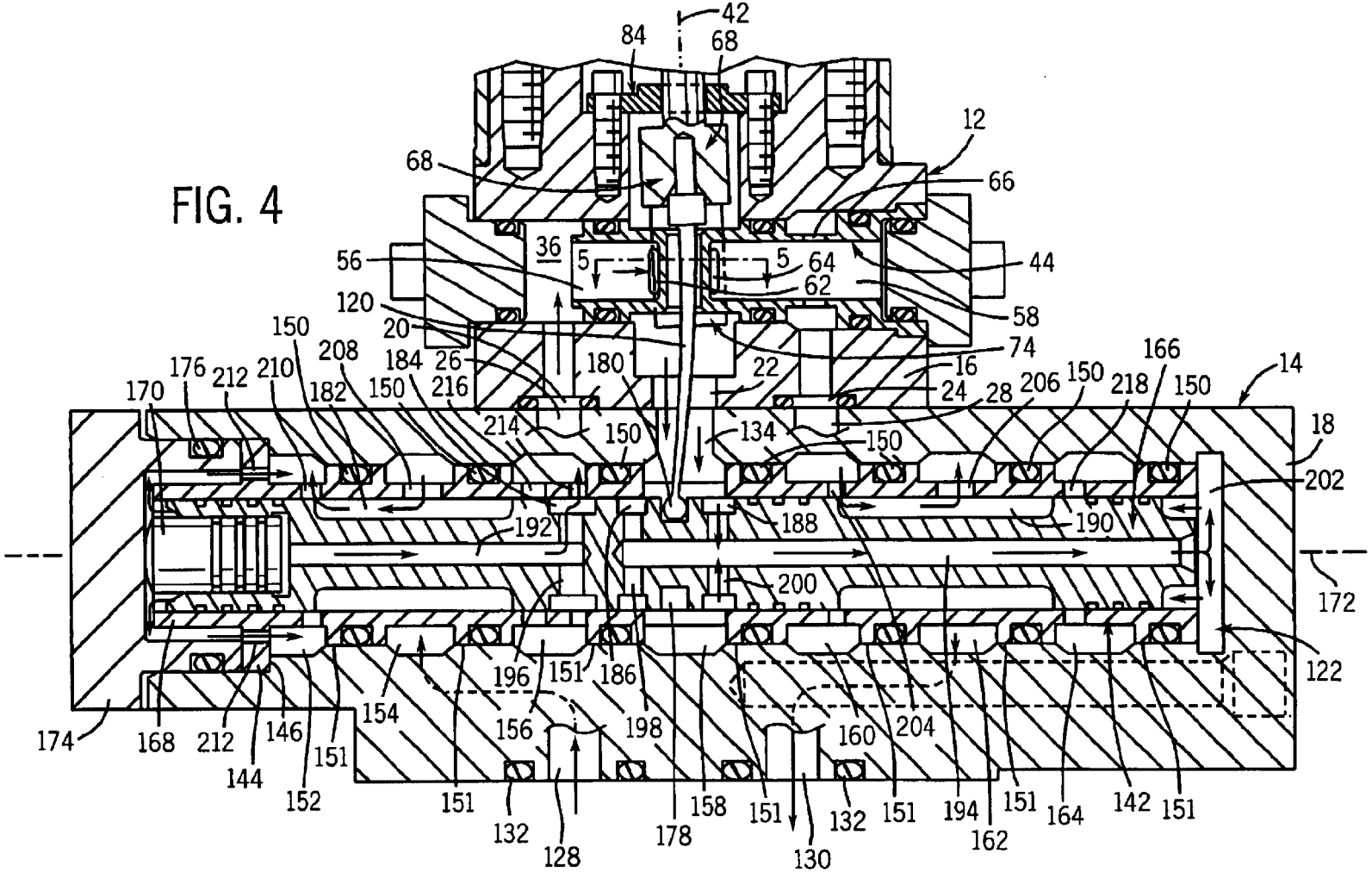
FIG. 4 is an enlarged partial sectional view as in FIG. 2 showing a valve second stage with a spool member in an extreme left position in which a first cylinder port is open to pressure.
Figure 6:
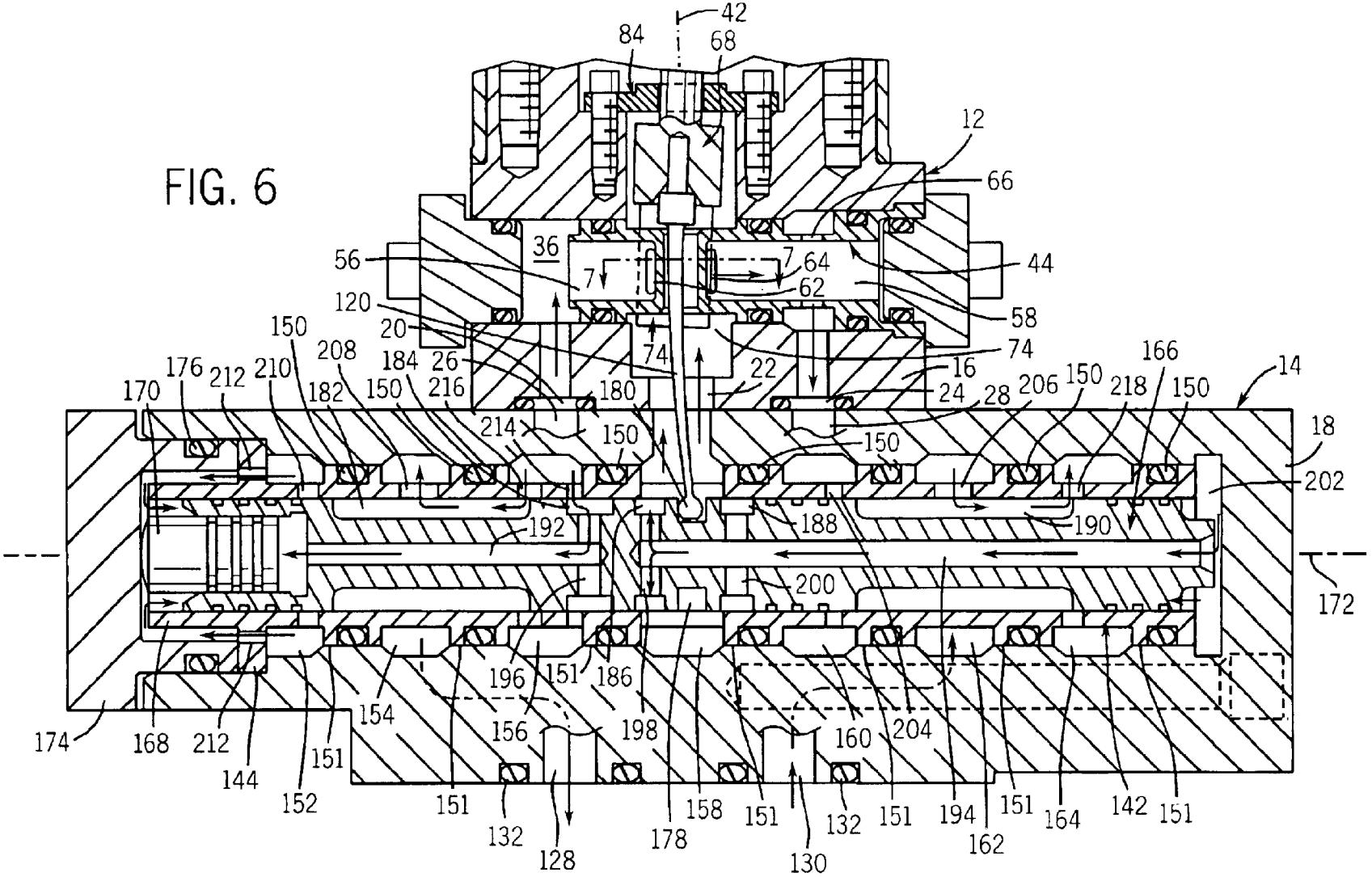
FIG. 6 is a view similar to FIG. 4 albeit with the spool valve in an extreme right position in which a second cylinder port is open to pressure.
Figure 8:
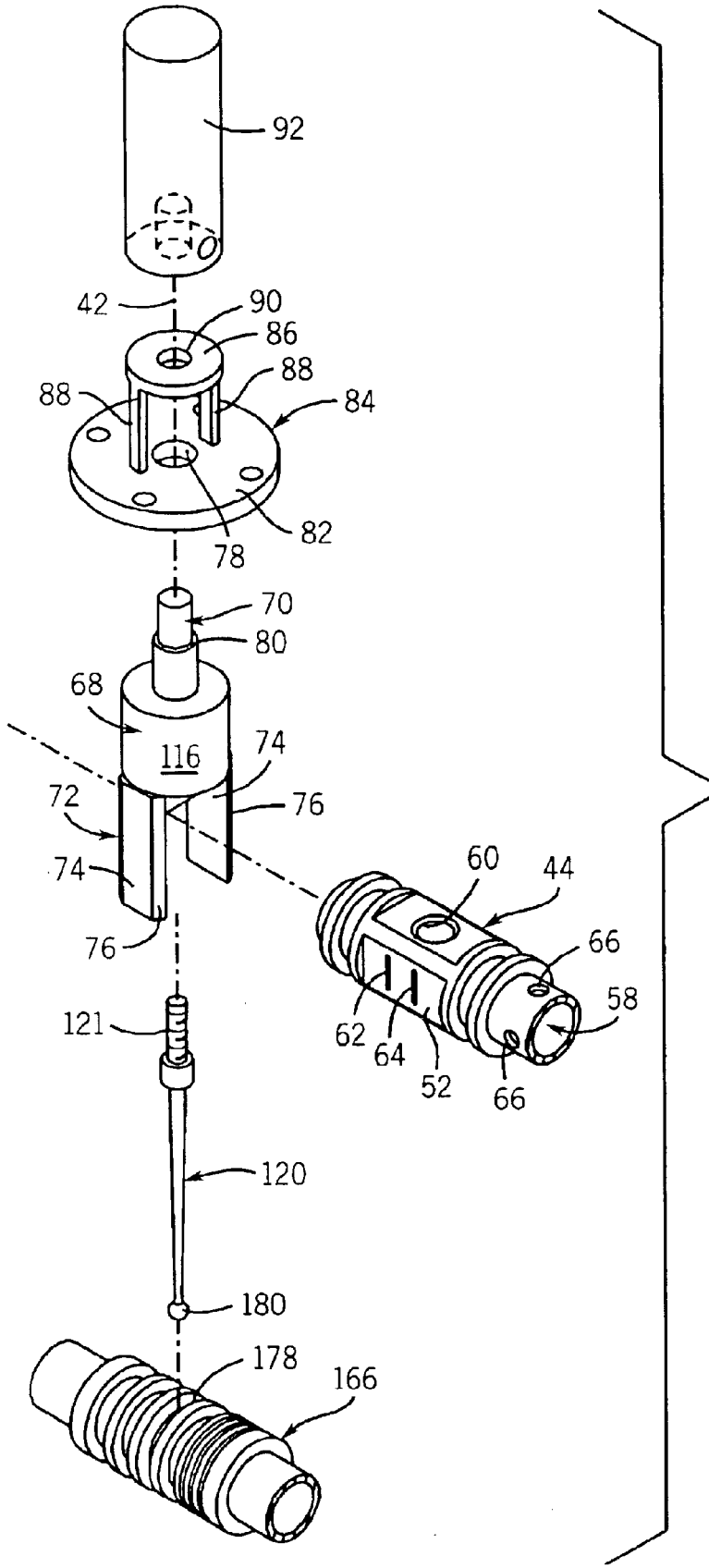
FIG. 8 is an exploded perspective view of a clevis pivot and feedback assembly of the valve.

Referring to FIGS. 3, 4 and 6, the clevis member 68 includes an enlarged body section 116 with a threaded bore 118 concentric with the main axis 42. A feedback spring 120 has a threaded end 121 that threads into the bore 118 to secure it to the clevis member 68. The feedback spring 120 provides a mechanical link between the first and second stages and provides an auto-nulling function for the first stage, as described below.

Referring now to FIGS. 4 and 6, the second stage valve unit 14 will be described in detail in a four-way valve construction. Note that it is within the scope of the invention to incorporate a two or three port second stage, especially in the event the valve is to be used for metering applications. The second stage housing 18 defines a valve chamber 122 and the passageways 26 and 28 mentioned above. The second stage housing 18 also defines a pressure port 124, a return port 126 and two flow ports, preferably input/output actuator cylinder ports 128 and 130, as shown in FIG. 1. The pressure 124 and return 126 ports couple the valve to a supply (and possibly a separate return) tank (not shown). In one application, the cylinder ports 128 and 130 can be coupled to separate cylinders of a piston actuating unit, such as for operating a compressor bleed valve in an aircraft turbofan engine. The second stage valve housing 18 has internal porting that leads from each of the pressure 124 and return 126 ports to open at two locations in the valve chamber 122. The second stage housing 18 also defines a central control inlet 134 in communication with the control port 22 of the first stage.

A guide sleeve 142 (inserted from an open end of the valve chamber 122 until a flange 144 abuts a ledge 146) is fixed at the interior of the valve chamber 122. The outer diameter of the guide sleeve 142 has a plurality of circumferential grooves holding o-rings 150 that seal against inwardly projecting circular lands 151 of the valve chamber 122 dividing it into seven separate annular channels 152–164 in communication with ports 124–130 and 134. Specifically, outer channels 152 and 164 communicate with the return port 126, intermediate channels 154 and 162 communicate separately with respective cylinder ports 128 and 130, inner channels 156 and 160 communicate with the pressure port 124 and the central channel 158 communicates with the control inlet port 134.

Within the center of the guide sleeve 142 is a spool member 166 having a cup end 168 defining a cavity in which is disposed a half-area piston 170 (as known in the art) having a circular cross-section of an area essentially one half that of the cup end 168. The piston 170 and the spool member 166 are disposed along a stroke axis 172 with the spool member 166 being slidable along the stroke axis 172 and the piston be fixed. Note that the slide surfaces of the spool member 166 and the piston 170 have a series of so called cleaning grooves to equalized pressure therebetween and reduce side loading on the spool member 166. An end cap 174 with an o-ring 176 seals the valve chamber 122 and presses against the flange 144 of the guide sleeve 142 to fix its position.

The spool member 166 defines an outer circumferential groove 178 at its center which receives a ball end 180 of the feedback spring 120 in a pivotal or swivel connection and defines five annular channels 182–190 spaced from the groove 178. The spool member 166 also defines two unconnected passageways 192 and 194 concentric with the stroke axis 172 and opening to opposite ends of the spool member 166. Passageway 192 communicates with annular channel 184 via bore 196 and passageway 194 communicates with annular channels 186 and 188 via respective bores 198 and 200.

As mentioned above, FIG. 2 illustrates the valve when both of the first and second stages are at the centered null position. In this position, both sets of nozzle orifices 62 and 64 are closed by the clevis member 68 and the spool member 166 is positioned so that the pressure port 124 is closed off from the cylinder ports 128 and 130. FIGS. 4 and 5 show the valve in a transient state in which the spool member 166 is being moved away from the piston 170. FIGS. 6 and 7 show the valve in another transient state in which the spool member 166 is being moved toward the piston 170.

With reference to FIGS. 3–5, the flow path of the fluid will now be described when positioning the spool member 166 from null to allow flow to pass out cylinder port 130 to one cylinder of the piston actuator. In this case, a current signal is supplied to the electromagnet to pull the armature 92 to the left side of the main axis 42 (as shown in the figures). This causes the clevis member 68 to pivot about the flexure pivot 84 so that its forked end 72 moves to the right, which opens nozzle orifices 62. This in turn allows flow from the open pressure port 20 to the control port 22 and into the second stage.

Referring to FIGS. 4 and 5, flow passes from the control inlet port 134 and into channel 188 then through bore 200 into passageway 194. The accumulation of pressurized fluid at space 202 bears against the right end of the spool member 166 to slide it toward the piston 170. This shift opens an orifice 204 to permit flow from the pressure port 124 (see FIG. 1) to pass into channel 190 and out through orifice 206 into channel 162 and eventually out through cylinder port 130 to one cylinder of the piston actuator. Flow from the opposite actuator cylinder flows through cylinder port 128 into channel 154 and then to the return port 126 (see FIG. 1) via orifice 208, channel 182, orifice 210 and channel 152. At the same time, the fluid displaced by movement of the spool member 166 passes through two orifices 212 in the flange 144 and into channel 152 to the return port. Equalizing flow from the displaced fluid in the cup end 168 of the spool member 166 passes through passageway 192, bore 196, channel 186, orifice 214 and channel 156 as needed to maintain the fixed position of the piston 170.

As can be seen, moving the spool member 166 in this way moves the ball end 180 of the feedback spring 120 to the left which bends the feedback spring 120 and imparts a spring force biasing the forked end 72 of the clevis member 68 to the left, back to its null position, thereby closing nozzle orifices 62 and stopping movement of the spool member 166. Since the pivoting of the clevis member 68 is proportional to the input current to the electromagnet, the stroke of the spool member 166 is also proportional to the input current, thus allowing the valve to be controlled very accurately.

Referring now to FIGS. 6 and 7, the flow path of the fluid will now be described when positioning the spool member 166 from null to allow flow to pass out cylinder port 128 to the other cylinder of the piston actuator. Here, an opposite polarity current signal is supplied to the electromagnet to pull the armature 92 to the right side of the main axis 42, which causes the clevis member 68 to pivot about the flexure pivot 84 so that its forked end 72 moves to the left to open nozzle orifices 64. This in turn allows flow from the control port 22 to the now open return port 24.

Flow passes from the control inlet port 134 after passing from channel 156, channel 186, bore 198, and passageway 194 by virtue of the spool member 166 being driven away from the piston 170 under pressure from flow passing from the pressure port 124 (see FIG. 1), through orifice 214, channel 184, bore 196 and passageway 192. This movement opens orifice 216 to allow flow from the pressure port to pass through channel 182, orifice 208, channel 154 and exit through the cylinder port 128. Fluid from the opposite actuator cylinder passes through port 130 into channel 162 through orifice 206 into channel 190 through orifice 218 to channel 164 and to the return port. Make up fluid is provided to the evacuated space between the end cap 174 and the cup end 168 of the spool member 166 through orifices 212 in the flange 144. Moving the spool member 166 in this way moves the ball end 180 of the feedback spring 120 to the right which imparts a spring force biasing the forked end 72 of the clevis member 68 to the right, back to its null position, thereby closing nozzle orifices 64 and stopping movement of the spool member 166.

The present invention thus provides an improved 4-way electrohydraulic servo valve that is both highly responsive and exhibits low null leakage. These and other benefits are derived in large part to the use of the clevis valve member in the first stage. The clevis arrangement is inherently pressure balanced such that it is highly insensitive to the affects of pressure loading and transient flow forces as well as to pump pressure noise common in hydraulic systems, which works to maximize the net drive force during operation. The valve is also highly efficient, empirically exhibiting very high first stage pressure recovery (approximately 97%) and very low hysteresis. The valve is also highly reliable and suitable for use in highly particle contaminated environments, such as jet fuel applications because of a high first stage pressure gain working to clear the spool in the event of sticking. In addition, the valve arrangement is closed centered in that the clevis prongs close the nozzle orifices at the null position such that the valve provides very low null leakage with variable transient flow.

It should be appreciated that merely a preferred embodiment of the invention has been described above. However, many modifications and variations to the preferred embodiment will be apparent to those skilled in the art, which will be within the spirit and scope of the invention. For example, the drawings and the above description describe a 4-way electrohydraulic servo valve, however, it is within the scope of the invention for the valve to have a three-way second stage in which case the second stage valve housing has only one cylinder port (along with the pressure and return ports) or a two-way second stage in which case it has only a pressure port and one unidirectional output flow port. As such, the valve is capable of operating as a metering valve in which fluid passes into the second stage from pressure and exits through the metering flow port. Therefore, the invention should not be limited to the described embodiment. To ascertain the full scope of the invention, the following claims should be referenced.

I claim:

1. An electrohydraulic servo valve, comprising:

a first stage servo unit having a drive assembly adapted to move a forked clevis member from a null position to alternatively open and close first and second nozzle orifices such that when the first nozzle orifice is open flow is permitted between a pressure port and a control port and when the second nozzle orifice is open flow is permitted between the control port and a return port; and a second stage valve unit having a sliding valve member and having an inlet port in communication with the first stage control port, a flow port and a pressure port, wherein flow from the second stage pressure port to the flow port is controlled by the sliding valve member;

whereby the clevis member and the sliding valve member are linked by a feedback spring such that movement of the sliding valve member imparts a feedback force to the feedback spring to return the clevis member to the null position such that movement of the sliding valve member is proportional to an input signal to the drive assembly.

2. The valve of claim 1, wherein the sliding valve member is a spool cooperating with a stationary piston.

3. The valve of claim 2, wherein the second stage valve unit includes a fixed guide sleeve in which the spool is slidable.

4. The valve of claim 2, wherein the piston has a cross-sectional area essentially one half that of a cup end of the spool.

5. The valve of claim 2, wherein the piston is held stationary by flow from the second stage pressure port.

6. The valve of claim 2, wherein the sliding valve member moves under the force of flow from the first stage control port.

7. The valve of claim 2, wherein the second stage valve unit further includes a return port.

8. The valve of claim 2, wherein the second stage valve unit further includes a second flow port and wherein the two flow ports are input/output ports and the spool alternatively closes off flow from the second stage pressure port to either of the input/output ports.

9. The valve of claim 2, wherein the feedback spring is pivotally engaged with the spool.

10. The valve of claim 9, wherein the feedback spring has a ball end and the spool as a groove receiving the ball end.

11. The valve of claim 1, wherein the drive assembly is a permanent magnet motor having a wire coil and a movable actuator member connected to the clevis member and disposed along a main axis.

12. The valve of claim 11, wherein the first stage valve unit further includes a flexure pivot allowing the clevis member to pivot with respect to the main axis to control flow through the nozzle orifices.

13. The valve of claim 12, wherein the flexure pivot has a movable part and a non-moving part in a plane spaced from the movable part and joined thereto by a flexible spoke.

14. The valve of claim 1, wherein the nozzle orifices are slots formed in a nozzle body.

15. The valve of claim 14, wherein there are two pairs of nozzles orifices on opposite flat sides of the nozzle body.

16. The valve of claim 15, wherein said nozzle body is partitioned and has a bore through the partition through which the feedback spring extends.

17. The valve of claim 16, wherein the partition is disposed between pairs of the nozzle orifices.

18. The valve of claim 17, wherein the forked end of the clevis member has two prongs disposed on opposite sides of the nozzle body.

19. The valve of claim 18, wherein each prong has tapered leading edges at opposite lateral sides.

20. The valve of claim 19, wherein the feedback spring is disposed through the first stage control port and the second stage inlet port.

21. A four-way electrohydraulic servo valve, comprising:

a servo first stage unit including:

a valve housing having pressure, control and return ports;

a magnetic drive assembly disposed in the valve housing selectively pulling an armature toward opposite sides of a main axis a flexure pivot disposed about the main axis and having a movable part mounted to the armature and a non-moving part fixed to the housing to allow pivoting of the actuator member with respect to the main axis;

a clevis member mounted to the armature and the movable part of the flexure pivot at one end and having a forked end defining two prongs symmetrical about the main axis, the clevis being pivotal about the flexure pivot in response to movement of the armature such that the clevis member moves from a null position to alternatively open and close first and second nozzle orifices;

a feedback spring mounted to the clevis member; and a spool valve second stage unit having a spool disposed in a valve housing having an inlet port in communication with the first stage control port, a pressure port, a return port and two input/output ports, wherein the spool valve is linked to the clevis member by the feedback spring disposed through the first stage control port and the second stage inlet port;

whereby movement of the spool valve imparts a feedback force to the feedback spring to return the clevis member to the null position such that movement of the spool is proportional to an input signal to the drive assembly.

22. An electrohydraulic servo valve, comprising:

a first stage servo unit having a drive assembly adapted to move a clevis member from a null position to alternatively open and close first and second nozzle orifices such that when the first nozzle orifice is open flow is permitted between a pressure port and a control port and when the second nozzle orifice is open flow is permitted between the control port and a return port; and a second stage valve unit having a sliding valve member and having an inlet port in communication with the first stage control port, a flow port and a pressure port, wherein flow from the second stage pressure port to the flow port is controlled by the sliding valve member;

whereby the clevis member and the sliding valve member are linked by a feedback member such that movement of the sliding valve member imparts a feedback force to the feedback member to return the clevis member to the null position such that movement of the sliding valve member is proportional to an input signal to the drive assembly.

* * * * *